US010874904B2

(12) United States Patent
Tudico

(10) Patent No.: US 10,874,904 B2
(45) Date of Patent: Dec. 29, 2020

(54) DEVICE FOR CONTROLLING THE PHYSICAL RESISTANCE FORCE PRODUCED BY A PATIENT, AND PHYSICAL REHABILITATION ASSEMBLY COMPRISING SUCH A DEVICE

(71) Applicant: Louisin Research and Development Limited, Dublin (IE)

(72) Inventor: Gianfranco Tudico, Bourg-les-Valence (FR)

(73) Assignee: LOUISIN RESEARCH AND DEVELOPMENT LIMITED, Dublin (IE)

( * ) Notice: Subject to any disclaimer, the term of this patent is extended or adjusted under 35 U.S.C. 154(b) by 181 days.

(21) Appl. No.: 15/745,742

(22) PCT Filed: Jul. 22, 2016

(86) PCT No.: PCT/EP2016/067517
§ 371 (c)(1),
(2) Date: Jan. 18, 2018

(87) PCT Pub. No.: WO2017/013243
PCT Pub. Date: Jan. 26, 2017

(65) Prior Publication Data

US 2018/0207486 A1 Jul. 26, 2018

(30) Foreign Application Priority Data

Jul. 23, 2015 (FR) ..... 15 56987

(51) Int. Cl.
*A63B 24/00* (2006.01)
*A63B 21/04* (2006.01)
(Continued)

(52) U.S. Cl.
CPC ..... *A63B 24/0087* (2013.01); *A63B 21/0435* (2013.01); *A63B 21/0442* (2013.01);
(Continued)

(58) Field of Classification Search
CPC ..... A63B 24/0087; A63B 24/0062; A63B 24/0006; A63B 21/0435; A63B 21/0552;
(Continued)

(56) References Cited

U.S. PATENT DOCUMENTS 1,416,741 A * 5/1922 Nicholls ..... A63B 21/04 482/129
4,253,663 A * 3/1981 Hughes ..... A63B 21/04 482/127

(Continued)

FOREIGN PATENT DOCUMENTS

DE 4040123 A1 6/1992

OTHER PUBLICATIONS

PCT Application No. PCTEP2016/067517, International Search Report, dated Oct. 14, 2016, 6 pages.

*Primary Examiner* — Sundhara M Ganesan
*Assistant Examiner* — Shila Jalalzadeh Abyaneh
(74) *Attorney, Agent, or Firm* — Soquel Group LLC

(57) ABSTRACT

A device including a frame, that is designed to be attached to a stationary structure element, at least one member for applying the forces produced by the patient, mounted on the frame and free to rotate about an axis of rotation that is fixed relative to the frame, a force sensor that measures, in a direction radial to the axis of rotation, the traction component of the forces applied to the member, and an angle sensor that measures the angular positioning of the member about the axis of rotation.

10 Claims, 3 Drawing Sheets

(51) Int. Cl.
*A63B 21/055* (2006.01)
*A63B 71/06* (2006.01)

(52) U.S. Cl.
CPC ..... *A63B 21/0552* (2013.01); *A63B 24/0003* (2013.01); *A63B 24/0006* (2013.01); *A63B 24/0062* (2013.01); *A63B 71/0619* (2013.01); *A63B 2024/0012* (2013.01); *A63B 2024/0068* (2013.01); *A63B 2024/0078* (2013.01); *A63B 2220/16* (2013.01); *A63B 2220/51* (2013.01); *A63B 2220/58* (2013.01)

(58) Field of Classification Search
CPC ..... A63B 21/0442; A63B 71/0619; A63B 2220/58; A63B 2220/16; A63B 2024/0078; A63B 2024/0068; A63B 2024/0012; A63B 24/0003; A63B 2220/51; A63B 21/02; A63B 21/022; A63B 21/023; A63B 21/04; A63B 21/055; A63B 21/1645; A63B 21/169; A63B 21/1609; A63B 21/1618; A63B 21/1627; A63B 21/1636; A63B 21/16; A63B 2220/50
See application file for complete search history.

(56) References Cited

U.S. PATENT DOCUMENTS 4,376,533 A * 3/1983 Kolbel ..... A63B 21/00185 482/125
4,598,908 A * 7/1986 Morgan ..... A63B 21/0724 482/104
5,234,394 A * 8/1993 Wilkinson ..... A63B 21/055 482/121
5,468,205 A * 11/1995 McFall ..... A63B 21/0552 482/121
5,484,368 A * 1/1996 Chang ..... A63B 21/0004 482/122
5,509,873 A * 4/1996 Corn ..... A63B 21/153 482/124
6,280,361 B1 8/2001 Harvey et al.
6,626,801 B2 * 9/2003 Marques ..... A63B 17/00 482/23
6,662,651 B1 * 12/2003 Roth ..... A61B 5/224 73/379.02
7,322,909 B1 * 1/2008 Loccarini ..... A63B 17/00 482/126
8,986,173 B1 * 3/2015 Adams ..... A63B 21/0557 482/106
2002/0187885 A1 * 12/2002 Liao ..... A63B 21/0552 482/126
2004/0152571 A1 * 8/2004 Udwin ..... A63B 21/153 482/128
2004/0176226 A1 9/2004 Carlson
2005/0130814 A1 * 6/2005 Nitta ..... A63B 21/055 482/121
2006/0094569 A1 * 5/2006 Day ..... A63B 22/0012 482/57
2007/0161468 A1 * 7/2007 Yanagisawa ..... A63B 23/03541 482/94
2008/0119763 A1 * 5/2008 Wiener ..... A63B 21/169 600/587
2008/0280738 A1 * 11/2008 Brennan ..... A63B 23/03525 482/129
2009/0017999 A1 * 1/2009 Halbridge ..... A63B 21/4035 482/130
2009/0227433 A1 * 9/2009 Humble ..... A63B 21/025 482/129
2010/0197462 A1 * 8/2010 Piane, Jr. ..... A61B 5/22 482/5
2011/0152045 A1 * 6/2011 Horne ..... A63B 24/0062 482/131
2012/0214651 A1 * 8/2012 Ross ..... A63B 7/00 482/129
2013/0172155 A1 * 7/2013 Adamchick ..... G06Q 50/22 482/8
2015/0126342 A1 * 5/2015 Kaye ..... A63B 23/03541 482/121
2015/0297932 A1 * 10/2015 Wehrell ..... A63B 21/00069 482/129

* cited by examiner

DEVICE FOR CONTROLLING THE PHYSICAL RESISTANCE FORCE PRODUCED BY A PATIENT, AND PHYSICAL REHABILITATION ASSEMBLY COMPRISING SUCH A DEVICE

CROSS REFERENCES TO RELATED APPLICATIONS

This application is a national phase entry of international application PCT/EP2016/067517, entitled DEVICE FOR CONTROLLING THE PHYSICAL RESISTANCE FORCE PRODUCED BY A PATIENT, AND PHYSICAL REHABILITATION ASSEMBLY COMPRISING SUCH A DEVICE, filed on Jul. 22, 2016 by applicant Louisin Research and Development Limited, the contents of which are hereby incorporated herein in their entirety.

PCT/EP2016/067517 claims benefit of French Patent Application No. 15 56987, on Jul. 23, 2015, the contents of which are hereby incorporated herein in their entirety.

FIELD OF THE INVENTION

The present invention relates to a device for controlling the physical resistance forces produced by a patient. The invention also relates to a patient physical rehabilitation assembly comprising such a control device.

BACKGROUND OF THE INVENTION

In the field of physical preparation or functional rehabilitation, small elastic accessories are commonly used, such as bands commonly called Sandows (trademark) or spring cages. These accessories allow a patient to be worked, sitting or standing, against progressive resistance: to do this, the patient puts the accessory under tension and then maintains this tension without relaxing it for a given period, while being all the time under the supervision of a therapist who ensures that the patient's posture is correct and that the intensity and direction of the resistance efforts produced by the patient are those expected for the required exercise. This technique allows both re-development of the muscles and the performance of proprioceptive work. In addition, this requires little financial investment and equipment, insofar as the aforementioned elastic accessories are inexpensive and take up almost no space. However, to be effective and not lead to muscular or joint demands not adapted to the treated patient, the exercises performed by the patient must be visually controlled by the therapist, so that the patient may not use these accessories independently.

There are also isokinetic machines that are generally used for the rehabilitation of athletes. The associated isokinetic method involves working the patient against resistance through constant velocity movements, wherein the resistance exerted by the isokinetic machine adapts itself to the effort produced by the patient. By virtue of the resistance that the machine regulates, this method makes it possible to obtain maximum muscle contraction at a constant speed, over the total amplitude of a movement. However, isokinetic machines are cumbersome and very expensive, and often only allow the lower limbs of the patient to be worked because the patient is usually sitting on an instrumented seat of the machine.

There are also mechanical devices that incorporate facilities that induce a mechanical resistance which the patient opposes during physical exercises. Examples of such devices are provided in US 2013/172155, US 2004/176226, DE 40 40 123 and U.S. Pat. No. 6,662,651. U.S. Pat. No. 6,280,361 even provides such devices equipped with a motor to generate the resistance. It should be understood that these "resistive" devices replace or complement the elastic accessories of the above-mentioned Sandow type, but are more sophisticated since they may comprise position sensors to provide patient feedback on the action of the patient on the device. However, due to the fact that the resistance of these devices is predetermined by the intrinsic mechanical design of these devices, their rehabilitation effect on the patient and, more generally, the work they provide to the patient are not as free and as precisely-controllable as Sandow-type "passive" elastic accessories: in this case, the therapist is not certain that these devices do not distort the work of the patient, which may lead the patient to seek to adapt his movements to the device, and thus to the detriment of the achievement of rehabilitation movements that are free in all spatial directions while being directly controlled. The aim of the present invention is to provide effective means of physical rehabilitation of a patient, which, while enabling their independent implementation by the patient, are easy and safe to use.

SUMMARY

To this end, an object of the invention is a device for controlling physical resistance forces produced by a patient, this device comprising:

- a frame which is designed to be fixed to a stationary structure element, such as a wall or wall bars,
- at least one member for applying the forces produced by the patient, which is mounted on the frame with free rotation about an axis of rotation fixed with respect to the frame,
- a force sensor for the, or each, member, which measures the traction component of the forces applied to the member in a direction radial to the axis of rotation, and
- an angle sensor for the, or each, member, which measures the angular positioning of the member about the axis of rotation.

The invention also relates to a patient physical rehabilitation assembly, comprising:

- a device for controlling the physical resistance forces produced by the patient, as defined above, and
- one or more elastic bands to be tensioned by the patient, such as Sandows, wherein each elastic band is, at one end, attached to the, or one of the, member(s) of the device while at the opposite end, each elastic band is designed to be held by, and/or attached to, the patient.

The control device according to the invention is simple to install and use and aims to help the therapist perform rehabilitation of the lower limbs as well as the upper limbs of the patient, through the patient's work, whether sitting or standing, against progressive resistance which is controlled and, advantageously, compared to a setpoint. For the purposes of the invention, the concept of "physical effort control" also covers the measurement and/or evaluation of these efforts. Thanks to the invention, the patient may perform work through movement, which may be of both small and large amplitude and in all spatial directions, while simultaneously the efforts produced by the patient may be applied to a freely-rotatable member of the control device: by means of this freely-rotatable member which, by definition, opposes the forces produced by the patient, no additional resistance other than that resulting from the frame, are measured, i.e., on the one hand, the traction component of the forces applied to this body by the patient via a force sensor, and, on the other hand, the angular positioning of these forces about the axis of rotation of this member via an angle sensor. The measurements of the force sensor and the angle sensor are advantageously processed to ensure that the forces developed by the patient correspond to pre-programmed intensity and positioning instructions of the therapist, in particular by real-time information feedback to the patient, typically via a control display, so that the device and the assembly according to the invention may be used by the patient autonomously and safely. By virtue of the invention, the therapist widens the therapeutic range and diversifies the exercises proposed to patients while maintaining the same spatial freedom for these exercises. The device and the assembly according to the invention may be adapted to all situations and allow all the muscle groups and all the joints of the patient to be worked.

According to additional advantageous features of the device according to the invention:

- Two members are respectively arranged on either side of the frame and are freely rotatable about the same rotation axis independently of one another.
- The, or each, member has a generally tubular shape within which are at least partially integrated the force sensor and the angle sensor associated with this member.
- The, or each, member comprises an attachment for fixing an elastic band to be tensioned by the patient, such as a Sandow, this attachment being connected to the rest of the member to rotate about the axis of rotation, and the force sensor comprises at least one strain gauge which is interposed between the attachment and the rest of the member.
- The angle sensor is magneto-resistive and comprises a fixed portion, which is fixedly connected to the frame, and a movable portion, which is connected to the associated member to rotate about the axis of rotation.
- The device further comprises electronic processing means for processing the signals respectively provided by the force sensor and the angle sensor.
- The device further comprises a screen for displaying the output of the electronic processing means.
- The device further comprises electronic processing means for processing the signals respectively provided by the force sensor and the angle sensor, the electronic processing means are designed to monitor the measurement provided by the force sensor and to determine the variation, as a function of time, of the intensity of the component traction of the forces applied to the associated member, these electronic processing means are also designed to monitor the measurement provided by the angle sensor and to determine the variation, as a function of time, of the angular position of the associated member about the axis of rotation.
- The device further comprises electronic processing means for processing the signals respectively provided by the force sensor and the angle sensor, these electronic processing means are simultaneously adapted:
  - to monitor the measurement supplied by the force sensor, to determine the variation, as a function of time, of the intensity of the traction component of the forces applied to the associated member, and to compare against a prerecorded setpoint, at least one characteristic of the variation of the said intensity, such as its maximum value, its minimum value, the number of times the said intensity passes between a low value and a high value, the duration and the rate of passage of the said intensity between a low value and a high value, the duration during which the said intensity remains lower than a low value, and the duration during which the said intensity remains greater than a high value, and
  - to monitor the measurement provided by the angle sensor, to determine the variation, as a function of time, of the angular position of the associated member about the axis of rotation, and to compare against a pre-recorded set point, at least one characteristic of the variation of the said angular position, such as its maximum value, its minimum value, and the duration during which the said angular orientation remains between two predetermined values.

BRIEF DESCRIPTION OF THE DRAWINGS

The invention will be better understood upon reading the description which follows, given solely by way of an example, and with reference to the drawings, wherein.

DETAILED DESCRIPTION

FIGS. 1 to 4 show a patient physical rehabilitation assembly 1. In addition to a device 10 for controlling the physical resistance forces produced by the patient, which will be described in detail later, the rehabilitation unit 1 comprises wall bars 2, which are fixed to a wall or the like, and elastic bands to be tensioned by the patient, wherein these bands are commonly called Sandows. Each of these elastic bands is designed to interact with the control device 10 at one of its opposite longitudinal ends, as will be detailed later, while at its other end, each elastic band is designed to be held by the patient and/or attached to the patient, for example held by the hand or attached to the patient's wrist or to the ankle. Insofar as the arrangements for connection between the elastic bands and the body of the patient are known per se, they will not be further described here as these arrangements do not limit the invention.

Figure 1:
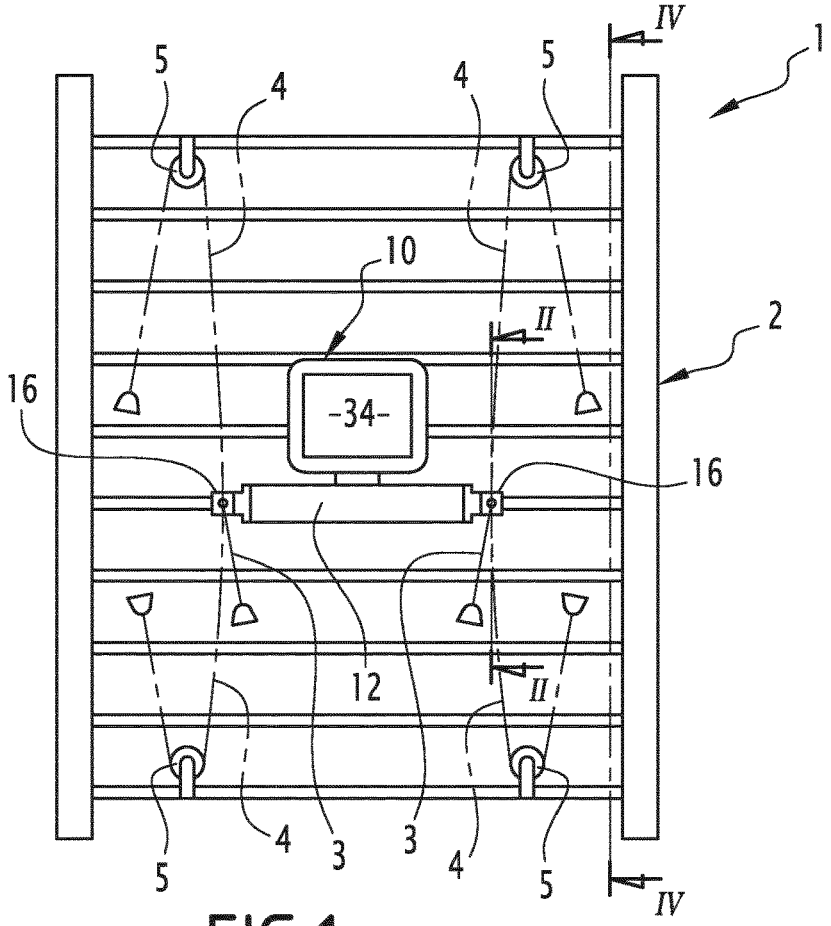
FIG. 1 shows an elevational view of a rehabilitation system according to the invention.
Figure 4:
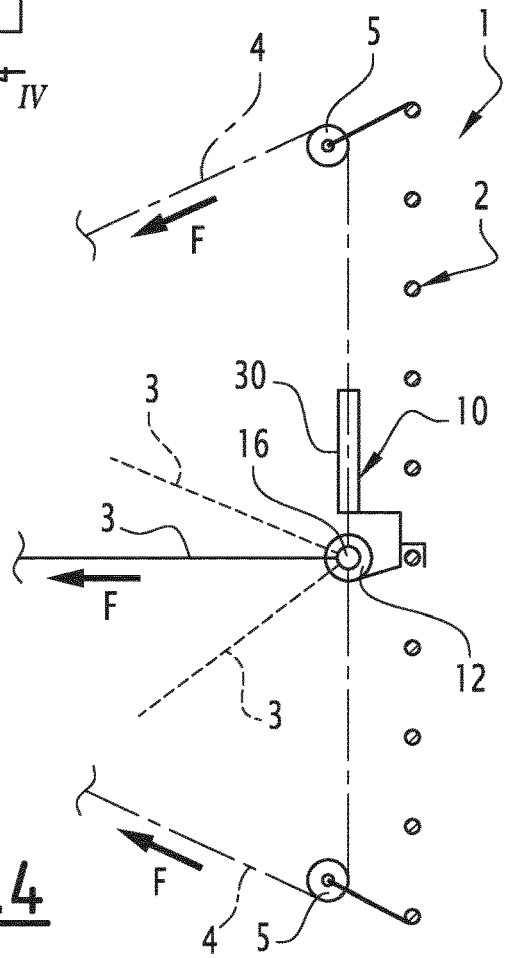
FIG. 4 shows a schematic section along the line IV-IV of FIG. 1, illustrating different configurations of use of the rehabilitation package.

Among the elastic bands of the rehabilitation assembly 1, there is a pair of elastic bands 3 shown in solid lines in FIGS. 1 and 4: these bands 3, which may be described respectively as being on the left and on the right, are intended to be respectively connected to the two halves of the body of the patient, for example to his left arm and to his right arm.

Also among the elastic bands of the rehabilitation assembly 1, there is a pair of long bands 4, wherein these two long bands 4 may be described respectively as left-hand and right-hand for the same reasons as those given above for the short bands 3. It should be noted that in FIGS. 1 and 4, the pair of long bands 4 is shown with dotted lines, while being drawn in duplicate only to illustrate various configurations of use of the rehabilitation assembly 1: a single long left band 4 and a single long right band 4 are likely to be used in practice.

In addition, in practice, more specifically during a given physical exercise, the patient is likely to put under tension either the short left band 3 or the long left band 4. This also applies to the right bands, respectively the short right band 3 and long right band 4, wherein it should be noted that the patient is, of course, likely to simultaneously tension one of the left elastic bands, namely the short band 3 or the long band 4, and one of the right elastic bands, namely the short band 3 or the long band 4. In practice, the elastic band(s) actually used in the rehabilitation assembly 1 depend(s) on the muscle groups and the joints of the patient that are to be made to work, as well as the posture of the patient during the treatment exercise, wherein it should be noted that the patient may be sitting or standing.

In addition, it should be noted that the rehabilitation assembly 1 also comprises pulleys 5 which are respectively arranged in the upper right quadrant, the lower right quadrant, the lower left quadrant and the upper left quadrant of the wall bars 2, and held there by any appropriate means, such as straps. Each of these pulleys 5 makes it possible to return one of the long elastic bands 4 during the tensioning of the latter, i.e., to bend the direction in which this long band extends: as shown schematically in FIGS. 1 and 4, wherein the pulleys 5 pass the long bands 4 from a substantially vertical orientation for their part extending between the control device 10 and the pulleys, to an inclined orientation relative to the vertical for the part of these bands 4 extending between the pulleys 5 and the patient.

Figure 2:
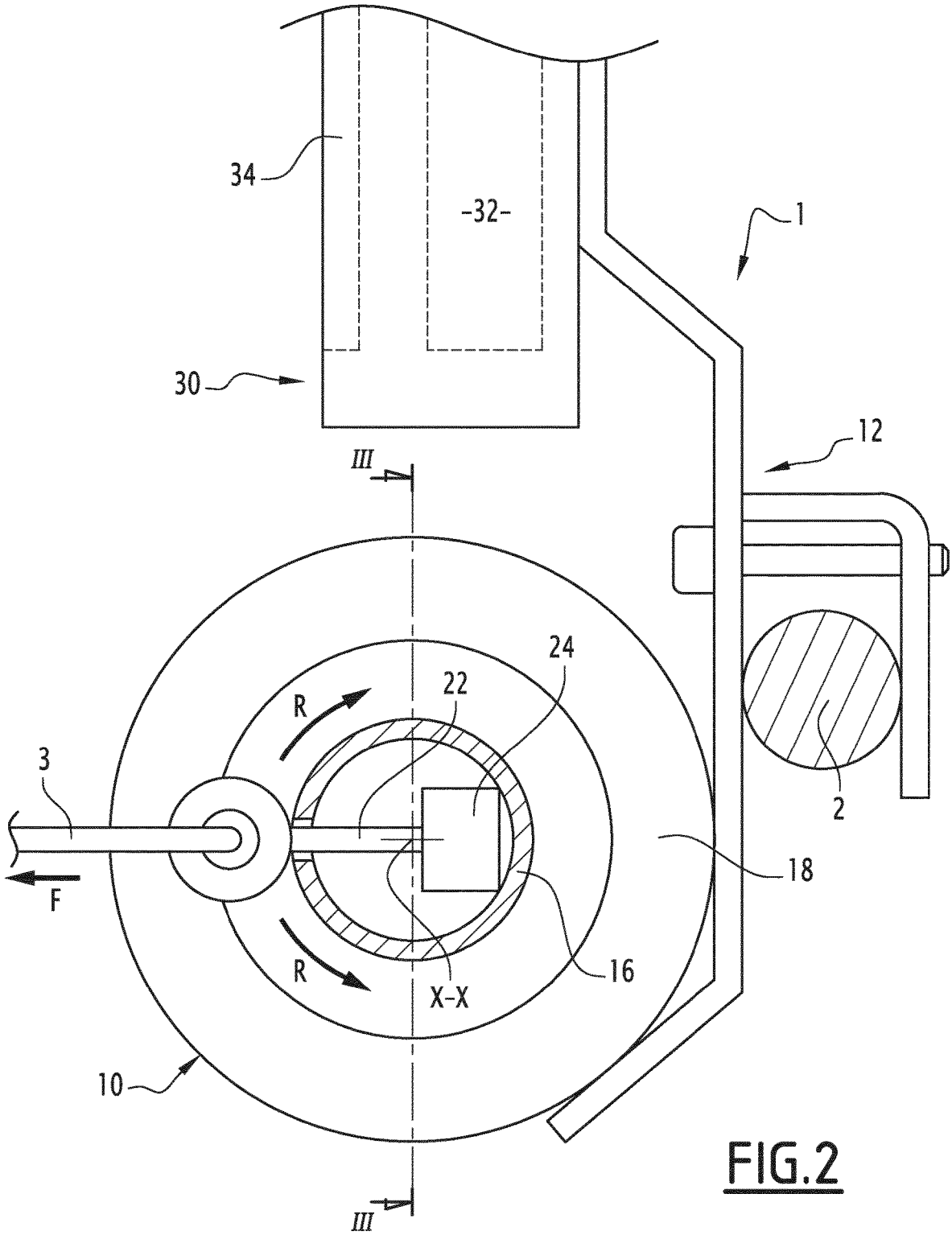
FIG. 2 shows a schematic section along the line II-II of FIG. 1, showing on a larger scale a control device according to the invention belonging to the assembly of FIG. 1.
Figure 3:
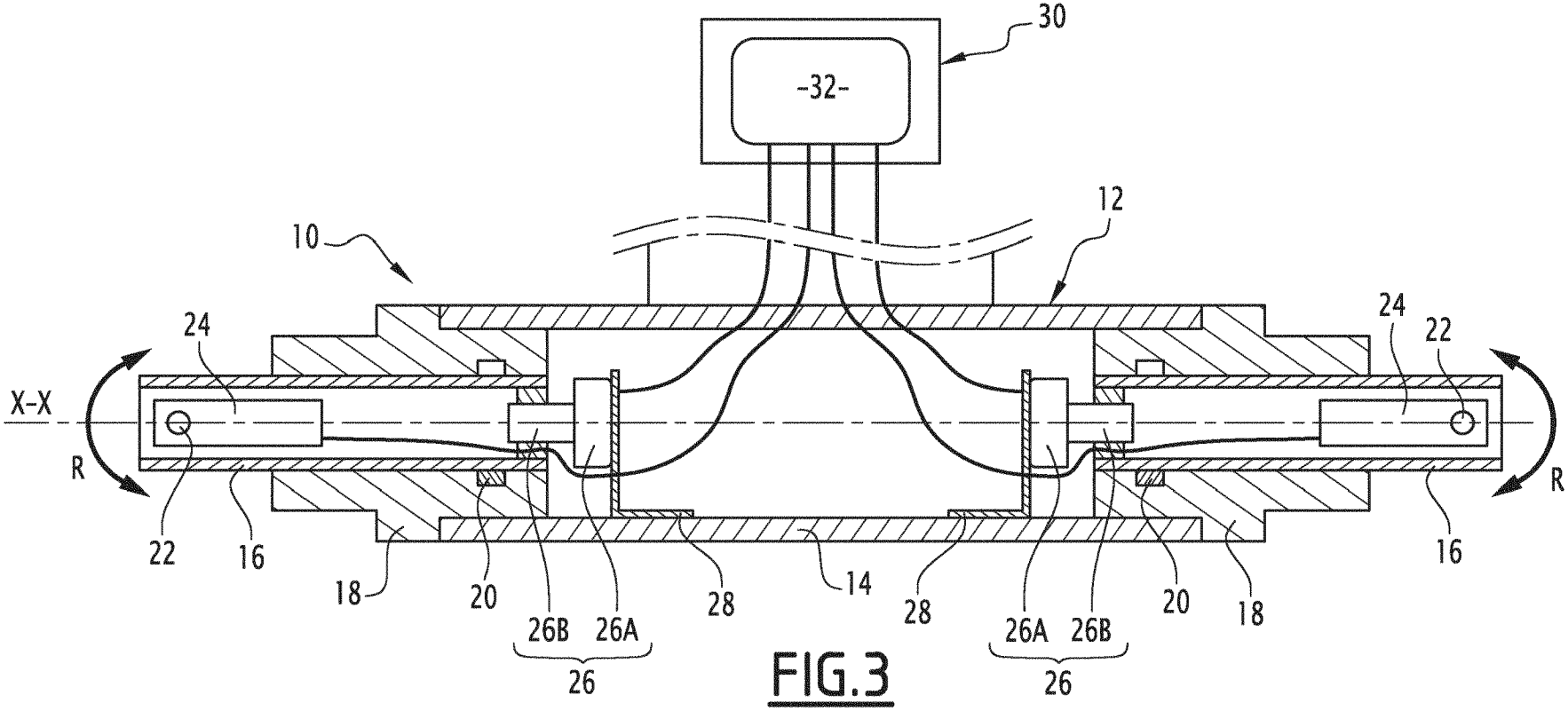
FIG. 3 shows a schematic section along the line III-III of FIG. 2.

As shown in more detail in FIGS. 2 and 3, the device 10 comprises a frame 12 which, in use, is fixed to the wall bars 2, in particular to an intermediate horizontal bar of the wall bars. The embodiment of the attachment between the frame 12 and the wall bars 2 is not limited and any mechanical fixing system, possibly adjustable, may be suitable, wherein it should be noted that, advantageously, a detachable system is preferred in order to detach the device 10 from the wall bars 2 if necessary, typically for storage purposes of the device, or when it is desired to use the wall bars 2 separately. As a variant (not shown), the frame 12 is designed to be attached not exclusively to wall bars, but, more generally, to any stationary structure element, for example directly to a wall.

In the exemplary embodiment considered in the figures, the frame 12 includes a tubular body 14, centered on a geometric axis X-X and with a circular base. When the device 10 is in use, the X-X axis preferably extends horizontally, wherein it should be understood that this X-X axis is fixed relative to the frame 12.

At each of its opposite axial ends, the body 14 carries a movable tubular member 16 coaxial with the axis X-X. Thus, as may be clearly seen in FIGS. 1 and 4, the two members 16 are arranged on either side of the frame 12 in the direction of the axis X-X. Each of the members 16 is mounted to rotate freely about the X-X axis on the corresponding end of the body 14 of the frame 12 via a bearing 18.

The embodiment of the bearings 18 is not limiting as long as the members 16 are, independently of one another, freely rotatable about the axis X-X relative to the body 14. In practice, each bearing 18 integrates a stop system 20, known per se, which limits the rotational movement around the axis X-X of the corresponding member 16 to approximately one turn with respect to the body 14, wherein it should be remembered that over this entire stroke, the relative rotation between the member 16 and the body 14 is free, i.e. not kinematically linked.

As may be clearly seen in FIG. 2, each member 16 is provided with an attachment 22 making it possible to attach one of the elastic bands 3 and 4 to it as required. In the embodiment considered in the figures, the attachment 22 comprises an eyelet through which the band 3 or 4 is threaded and fixed to the corresponding member 16. Whatever its embodiment, the attachment 22 is secured to the rest of the member 16 in order to be at least linked to this member 16 in rotation about the axis X-X: it is understood that, in use, when the elastic band 3 or 4, attached to the member 16 by the corresponding attachment 22, is tensioned by the patient, the forces F produced by this patient, in particular the resistance forces maintaining the elastic band in tension, are applied to the member 16 and thus impose on the latter its angular positioning about the axis X-X. Thus, as indicated schematically in FIGS. 2 and 4, when one of the short elastic bands 3 is attached to the corresponding member 16, the orientation of this band 3 relative to the horizontal, resulting from its positioning and its maintaining tension in response to the forces F produced by the patient, induces an identical angular positioning of the member 16 about the axis X-X through free rotation of this member relative to the frame 12, as indicated by the arrows R in FIGS. 2 and 3. Similarly, when one of the long elastic bands 4 is used while being returned by the corresponding pulley 5, the substantially vertical orientation of the part of this band 4 extending from the member 16 to the pulley 5, induces the member 16 to rotate about the axis X-X so that its attachment 22 is directed substantially vertically towards the corresponding pulley 5.

The device 10 further comprises, for each member 16, a force sensor 24 which, in the embodiment considered here, is advantageously integrated inside the tubular wall of the member 16. As a non-limiting example, the force sensor 24 includes one or more strain gauges, which are interposed between the corresponding attachment 22 and the rest of the member 16. Whatever the form of the embodiment, the force sensor 24 is sensitive to mechanical stresses applied to the member 16 in a direction about the axis X-X, so that, within the device 10, each force sensor 24 makes it possible to measure, in a direction about the axis X-X, the traction component of the forces F applied by the patient to the corresponding member 16.

The device 10 further comprises, for each member 16, a sensor other than the force sensor 24, namely an angle sensor 26 which makes it possible to measure the angular positioning of the member 16 about the axis X-X. According to a non-limiting embodiment, which is implemented in the example considered in the figures, each angle sensor 26 is a magneto-resistive sensor, comprising, on the one hand, a fixed part 26A that is fixedly connected to the frame 12 via a bracket 28 to support the fixed part 26A of the angle sensor 26, and that is fixedly integrated inside the tubular body 14, and, on the other hand, a mobile part 26B that is rotatably connected to the member 16 about the axis X-X, wherein it is advantageously integrated inside the tubular wall of the member 16.

It should be understood that for each member 16, the measurements respectively provided by the force sensor 24 and by the angle sensor 26 make it possible to control the physical resistance forces F produced by the patient to put and maintain the elastic band 3 under tension or 4 without this body 16 opposing its own resistance: the measurement provided by the force sensor 24 makes it possible to determine the intensity of the forces F, more precisely the intensity of the traction component of these efforts F to which the force sensor 24 is sensitive, while the measurement provided by the angle sensor 26 makes it possible to determine the spatial orientation about the axis X-X, of the elastic band 3 or 4, more precisely the angular position of the member 16 about the axis X-X imposed by the portion of this band fixed to the attachment 22.

The signals respectively provided by the force sensor 24 and by the angle sensor 26 associated with each member 16, representative of the measurements respectively effected by these two sensors, are transmitted, typically via a wired connection to a unit 30 designed to process these signals and display the result of this processing. Thus, in the embodiment considered here and as indicated only schematically in FIGS. 2 and 3, the unit 30 comprises, on the one hand, electronic processing means 32 for processing the aforementioned signals, comprising, for example, a microprocessor and a computer memory, and, on the other hand, a screen 34 for displaying the output of the electronic processing means 32. In practice, the electronic processing means 32 and the display screen 34 operate in real time in order to give the patient immediate feedback on the resistance forces F that the patient produces, as well as on the angular position at which the exercise is performed via the screen 34 during the processing and display.

According to a preferred embodiment, the electronic processing means 32 are designed to monitor the measurements respectively provided by the force sensor 24 and the angle sensor 26 associated with each member 16 during the entire period of physical exercise. The electronic processing means 32 are then provided to determine the variation, as a function of time, of both the intensity of the traction component of the forces F applied to the member 16, and the angular position of this member about the X-X axis: wherein the variation of this intensity and the variation of this angular position are advantageously displayed on the screen 34, for example in the form of curves or other graphic forms, during the exercise. This feedback may also be accompanied by sound effects.

Subsequent to the above considerations, the electronic processing means 32 are advantageously designed to both memorize a setpoint, typically pre-recorded by a therapist, and to compare this setpoint with at least one characteristic of the variation of the intensity of the traction component of the forces F and/or the variation of the angular position of the corresponding member 16. The result of this comparison is either made available in real time to the patient via the display screen 34, or memorized for subsequent analysis by the therapist, wherein these two alternatives may of course be cumulated. It should be understood that this provision allows the therapist to set instructions for physical rehabilitation to the patient before the beginning of a rehabilitation exercise, so that during this exercise, the patient may be controlled in real time by himself and/or by the therapist with respect to these rehabilitation instructions.

The characteristic(s) of the variation of the intensity of the traction component of the forces F, which are compared by the electronic processing means 32 against pre-recorded instructions, is/are advantageously chosen from among:

- the maximum value of this intensity,
- the minimum value of this intensity,
- the number of times this intensity passes between a predetermined low value and a predetermined high value,
- the duration and the speed of passage of this intensity from a predetermined low value to a predetermined high value,
- the duration and the speed of passage of this intensity from a predetermined high value to a predetermined low value,
- the duration during which this intensity remains equal to or lower than a predetermined low value, and
- the duration during which this intensity remains equal to or greater than a predetermined high value.

In practice, the above-mentioned low and high values are set by the therapist, with tolerances that are themselves adjustable.

The characteristic(s) of the variation of the angular position of each member 16, which is/are compared by the electronic processing means 32 to pre-recorded instructions, is/are advantageously chosen from:

- the maximum value of this angular orientation,
- the minimum value of this angular orientation, and
- the duration during which this angular orientation remains between two predetermined values.

In practice, the two aforementioned values are set by the therapist and accompanied by tolerances, that are themselves adjustable.

As a purely illustrative detailed example, for a physical exercise during which the patient must stand up and use at least one of the short straps 3, the therapist adjusts the instructions stored by the device 10 so that:

- during the entire duration of the exercise, the member 16 attached to the band 3 should be so oriented angularly that the band extends horizontally, while deviating at most between the two orientations drawn in dashed lines in FIG. 4, and
- between the beginning and the end of the exercise, the band 3 should be tensioned ten times, each time from a tension of substantially zero to a tension with an intensity equivalent to 10 kg±1 kg, wherein the band 3 is maintained, each time, at rest and under full tension for ten seconds, while passing each time between rest and full tension in less than two seconds.

Of course, based on this example and the explanations given above in this document, it should be understood that the device 10 and the rehabilitation assembly 1 make it possible to carry out very varied physical exercises, in this case gain in amplitude, evaluation of the maximum strength of a limb at the beginning and the end of rehabilitation, specific muscle strengthening, both analytic and global, both under load and released from load, in the muscle chain, up to proprioceptive work and the reproduction of sporting movements, against the resistance offered by the bands 3 and 4.

The invention claimed is:

1. A patient physical rehabilitation assembly, comprising:

at least one elastic band to be tensioned by a patient, comprising:

a first end that is configured to be held by or attached to the patient; and a second end that is opposite to the first end; and a device configured for controlling physical resistance effort produced by the patient to tension said at least one elastic band, the device comprising:

a frame configured to be fixed to a stationary structure element, the frame comprising a tubular body defining a rotation axis that is fixed with respect to the frame, said tubular body comprising two ends that are opposed along the rotation axis;

at least one rotating member which is protrudingly mounted at one of said two ends of said tubular body and which rotates freely with respect to said frame about the rotation axis, the at least one rotating member comprising an attachment that is connected fixedly in rotation about the rotation axis to the rest of the at least one rotating member, said second end of said at least one elastic band being attached fixedly in rotation about the rotation axis to the attachment so that when said at least one elastic band is tensioned by the patient, said at least one elastic band both (i) extends lengthwise from the at least one rotating member in a tensioning direction, which is transverse to and intersects the rotation axis, and (ii) applies to the at least one rotating member forces, which are produced by the patient to tension said at least one elastic band and which are oriented in the tensioning direction;

a force sensor integrated within each of said at least one rotating member, and which measures, in a radial direction that is perpendicular to the rotation axis, a traction radial component of the forces for any angular orientation of the tensioning direction about the rotation axis; and an angle sensor for each of said at least one rotating member, which measures an angular position of the rotating member about the rotation axis.

2. The patient physical rehabilitation assembly according to claim 1, further comprising electronic processing means for processing signals respectively provided by said force sensor and said angle sensor associated with each of said at least one rotating member.

3. The patient physical rehabilitation assembly according to claim 2, further comprising a screen for displaying an output of said electronic processing means.

4. The patient physical rehabilitation assembly according to claim 1, further comprising electronic processing means for processing the signals respectively provided by said force sensor and said angle sensor of each of said at least one rotating member, and wherein, for each of said at least one rotating member said electronic processing means are simultaneously adapted (i) to monitor measurements provided by said force sensor associated with the rotating member, to determine a variation, as a function of time, of an intensity of the traction radial component of the forces applied to the rotating member, and to compare against a prerecorded setpoint, at least one characteristic of the variation of the intensity, and (ii) to monitor measurements provided by said angle sensor associated with the rotating member, to determine a variation, as a function of time, of the angular position of the rotating member about the rotation axis, and to compare against a pre-recorded setpoint, at least one characteristic of the variation of the angular position.

5. The patient physical rehabilitation assembly according to claim 4, wherein the at least one characteristic of the variation of the intensity is chosen from among a maximum value of the intensity, a minimum value of the intensity, a number of times the intensity passes between a low value and a high value, a duration and a rate of passage of the intensity between a low value and a high value, a duration during which the intensity remains lower than a low value, and a duration during which the intensity remains greater than a high value, and wherein the at least one characteristic of the variation of the angular position is chosen from a maximum value of the angular position, a minimum value of the angular position, and a duration during which the angular position remains between two predetermined values.

6. The patient physical rehabilitation assembly according to claim 1, wherein each of said at least one rotating member has a generally tubular shape, which is centered on the rotation axis, and within which is at least partially integrated said angle sensor.

7. The patient physical rehabilitation assembly according to claim 1, wherein, for each of said at least one rotating member, said force sensor comprises at least one strain gauge which is interposed between said attachment of the rotating member and the rest of the rotating member.

8. The patient physical rehabilitation assembly according to claim 1, wherein, for each of said at least one rotating member, said angle sensor is magneto-resistive and comprises a fixed portion, which is fixedly connected to said frame, and a movable portion, which is connected fixedly in rotation about the rotation axis to the rotating member.

9. The patient physical rehabilitation assembly according to claim 1, further comprising electronic processing means for processing signals respectively provided by said force sensor and said angle sensor associated with each of said at least one rotating member, wherein, for each of said at least one rotating member said electronic processing means are designed (i) to monitor measurements provided by said force sensor associated with the rotating member and to determine a variation, as a function of time, of an intensity of the traction radial component of the forces applied to the rotating member, and (ii) to monitor measurements provided by said angle sensor associated with the rotating member and to determine a variation, as a function of time, of the angular position of the rotating member about the rotation axis.

10. A patient physical rehabilitation assembly, comprising:

two elastic bands to be tensioned by a patient, each elastic band comprising:

a first end that is configured to be held by or attached to the patient; and a second end that is opposite to the first end; and a device configured for controlling physical resistance effort produced by the patient to tension the two elastic bands, the device comprising:

a frame configured to be fixed to a stationary structure element, the frame comprising a tubular body defining a rotation axis that is fixed with respect to the frame, the tubular body comprising two ends that are opposed along the rotation axis;

two rotating members, which are protrudingly mounted at the two ends of said tubular body so as to be respectively arranged on either side of said frame, both of which freely rotate with respect to said frame about the rotation axis independently of one another, and each of which comprises an attachment that is connected fixedly in rotation about the rotation axis to the rest of the corresponding rotating member, said second ends of said two elastic bands being respectively attached fixedly in rotation about the rotation axis to the attachments of the two rotating members so that when each of said two elastic bands is tensioned by the patient, the elastic band both (i) extends lengthwise from the corresponding rotating member in a tensioning direction, which is transverse to and which intersects the rotation axis, and (ii) applies to the corresponding rotating member forces, which are produced by the patient to tension the elastic band and which are oriented in the tensioning direction;

a force sensor integrated within each of said two rotating members, and which measures, in a radial direction that is perpendicular to the rotation axis, a traction radial component of the forces for any angular orientation of the tensioning direction about the rotation axis; and an angle sensor for each of said two rotating members, which measures an angular position of the rotating member about the rotation axis.

* * * * *